US007629990B2

(12) United States Patent
Nishi

(10) Patent No.: US 7,629,990 B2
(45) Date of Patent: Dec. 8, 2009

(54) THERMAL PRINT HEAD

(75) Inventor: Koji Nishi, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 75 days.

(21) Appl. No.: 11/792,636

(22) PCT Filed: Dec. 8, 2005

(86) PCT No.: PCT/JP2005/022530

§ 371 (c)(1),
(2), (4) Date: Oct. 18, 2007

(87) PCT Pub. No.: WO2006/062151

PCT Pub. Date: Jun. 15, 2006

(65) Prior Publication Data

US 2008/0100686 A1 May 1, 2008

(30) Foreign Application Priority Data

Dec. 10, 2004 (JP) ..... 2004-358649

(51) Int. Cl.
*B41J 2/34* (2006.01)

(52) U.S. Cl. ..... 347/208

(58) Field of Classification Search ..... 347/208, 347/204, 206, 207, 209
See application file for complete search history.

(56) References Cited

U.S. PATENT DOCUMENTS

| | | | | |
|---|---|---|---|---|
| 5,142,300 | A | 8/1992 | Aoki | |
| 6,149,265 | A | 11/2000 | Watanabe | |
| 6,441,840 | B1 * | 8/2002 | Sato et al. | 347/208 |

FOREIGN PATENT DOCUMENTS

| | | |
|---|---|---|
| JP | 2-283462 | 11/1990 |
| JP | 7-314755 | 12/1995 |
| JP | 11-70658 | 3/1999 |
| JP | 2001-341311 | 12/2001 |
| JP | 2003-165239 | 6/2003 |

* cited by examiner

*Primary Examiner*—K. Feggins
(74) *Attorney, Agent, or Firm*—Hamre, Schumann, Mueller & Larson, P.C.

(57) ABSTRACT

A thermal printhead (A1) includes a substrate (1), and a plurality of heating portions (2) aligned on the substrate in a primary scanning direction (X). A plurality of electrodes (31, 32, 33) are connected to the heating portions (2). Each of the heating portions (2) has a width in the primary scanning direction (X) which is smaller than that of each of the electrodes (31, 32, 33). Each of the electrodes (31, 32, 33) includes a tapered portion (31C, 32C, 33C) having a width which reduces as progressing toward a corresponding one of the heating portions 2.

7 Claims, 6 Drawing Sheets

THERMAL PRINT HEAD

TECHNICAL FIELD

The present invention relates to a thermal printhead used for a thermal printer.

BACKGROUND ART

An example of conventional thermal printhead is shown in FIG. 6 (See Patent Document 1 below). The illustrated thermal printhead B includes a substrate 91 and a plurality of heating portions 92 formed on the substrate. The heating portions 92 are aligned in the primary scanning direction and grouped into pairs. As shown in the figure, in each of the pairs, the respective lower ends of the heating portions 92 are connected to each other by an intermediate electrode 93. In each pair, the upper end of the left heating portion 92 is connected to an individual electrode 94, whereas the upper end of the right heating portion 92 is connected to an individual electrode 95. For instance, when power is supplied between the individual electrodes, current flows from the left heating portion 92 to the right heating portion 92 through the intermediate electrode 93. As a result, the paired heating portions 92 are heated to function as a single print dot.

Recently, there is an increasing demand for high-definition thermal printers. To meet this demand, the heating portions need to have a finer structure. To make the conventional heating portions 92 fine, it is necessary to reduce the width of the individual electrodes 94, 95 and the intermediate electrode 93. However, when the width is reduced, the amount of current which can be caused to flow through the electrodes is reduced, so that the current to be supplied to the heating portions 92 becomes insufficient. As a result, the time required for raising the temperature of the heating portions 92 to a temperature suitable for printing increases, so that the printing speed of the thermal printer is reduced.

Patent Document 1: JP-A-2003-165239

DISCLOSURE OF THE INVENTION

The present invention is proposed under the circumstances described above. It is an object of the present invention to provide a thermal printhead which is capable of performing high-definition and high-speed printing.

To solve the above-described problems, the present invention takes the following technical means.

According to the present invention, there is provided a thermal printhead comprising a substrate, a plurality of heating portions arranged on the substrate at a predetermined pitch in a primary scanning direction, and a plurality of electrodes connected to the heating portions. Each of the electrodes includes a tapered portion having a width which reduces toward a corresponding one of the heating portions.

With this structure, heating portions can be made fine while making each of the electrodes wide to reduce the resistance. When the resistance is low, a large amount of current can be supplied to the heating portions, so that the time required for raising the temperature of the heating portions to a temperature suitable for printing is shortened. As a result, high-definition and high-speed printing can be performed. Further, when the electrodes are wide, problems such as the disconnection of the electrodes can be reduced. Moreover, the width of the electrode gradually reduces at the tapered portion. Thus when the current flows from the electrode to the heating portion, the direction of the current flow is not locally disturbed. Therefore, non-uniform distribution of heat generation in each of the heating portions can be avoided, whereby print dots are not blurred or distorted.

Preferably, the electrodes include a plurality of intermediate electrodes each of which is U-shaped and/or a plurality of individual electrodes elongated in the secondary scanning direction. Each of the intermediate electrodes is connected to paired ones of the heating portions. Each of the individual electrodes is connected to a corresponding one of the heating portions. The heating portions are aligned in the primary scanning direction. Each pair of adjacent heating portions forms a unit having a heat generating function (heating dot). Each of the intermediate electrodes connects the paired heating portions to each other. Each of the individual electrodes may be connected to a respective one of the heating portions at a position on the opposite side of the intermediate electrode. With this arrangement, the heating portions can be arranged at a position which is offset toward an edge of the substrate. As a result, the heating portions can be pressed against e.g. thermal paper or a thermal ribbon with high pressure, which is advantageous for performing high-definition and high-speed printing.

Preferably, the tapered portion includes a first edge and a second edge which are spaced from each other in the primary scanning direction. The first edge extends in parallel with the secondary scanning direction, whereas the second edge is inclined with respect to the secondary scanning direction. This structure is suitable for arranging paired heating portions close to each other. When the paired heating portions are close to each other, the heating portions, both generating heat, can heat each other when energized. Therefore, the time required for raising the temperature of the paired heating portions to a temperature suitable for printing is shortened, which is advantageous for increasing the printing speed.

Both of the first edge and the second edge of the tapered portion may be inclined with respect to the secondary scanning direction. In this instance, the first edge and the second edge may be axisymmetric with respect to an imaginary line extending in parallel with the secondary scanning direction. The imaginary line may extend to halve a corresponding one of the heating portions. With this structure, a relatively large distance is secured between the paired heating portions. Therefore, it is possible to prevent the heating portions from heating each other and repetitively reaching an excessively high temperature. Therefore, the durability of the thermal printhead is enhanced, while achieving printing with high speed.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
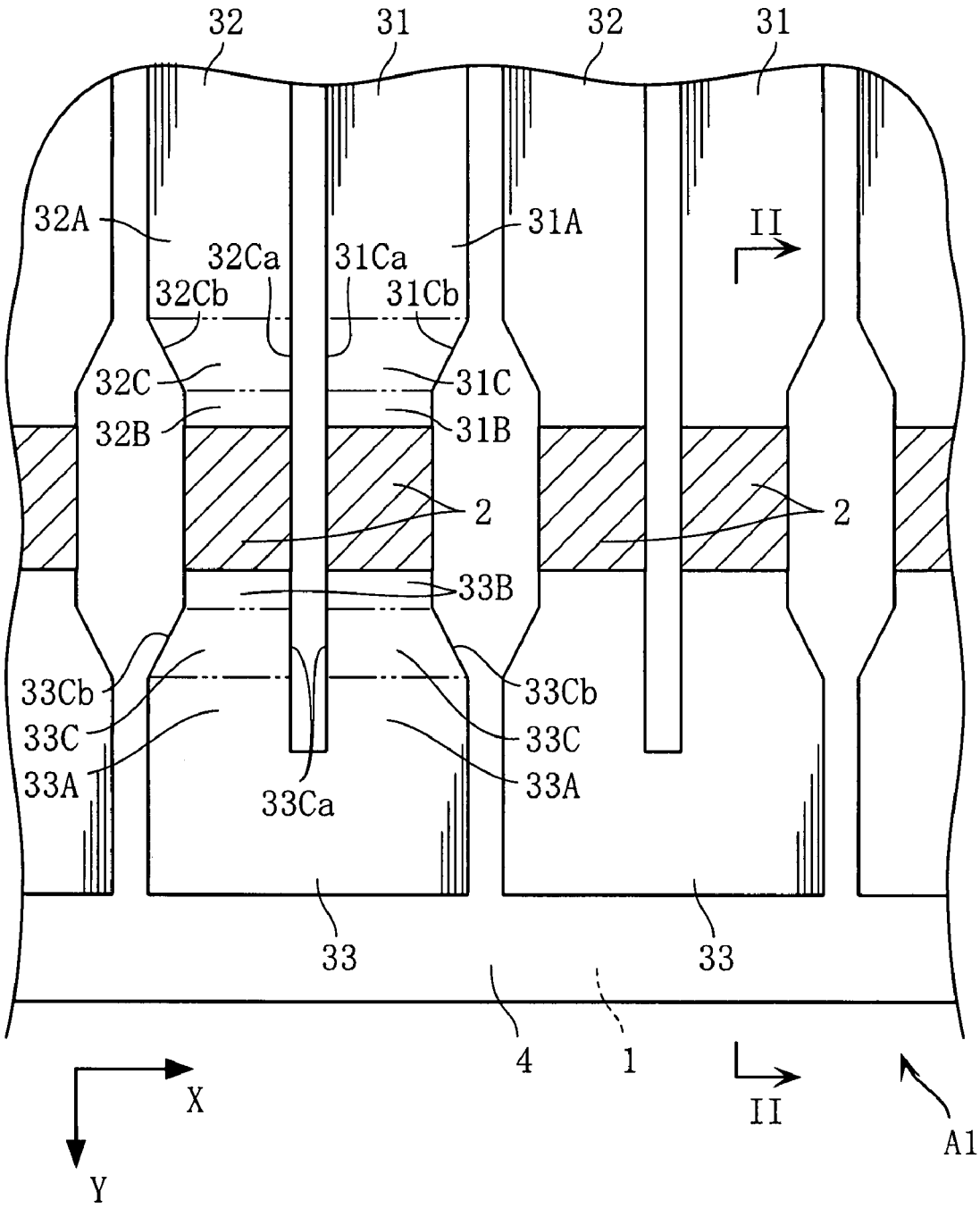
FIG. 1 is a plan view showing a principal portion of a thermal printhead according to a first embodiment of the present invention.
Figure 2:
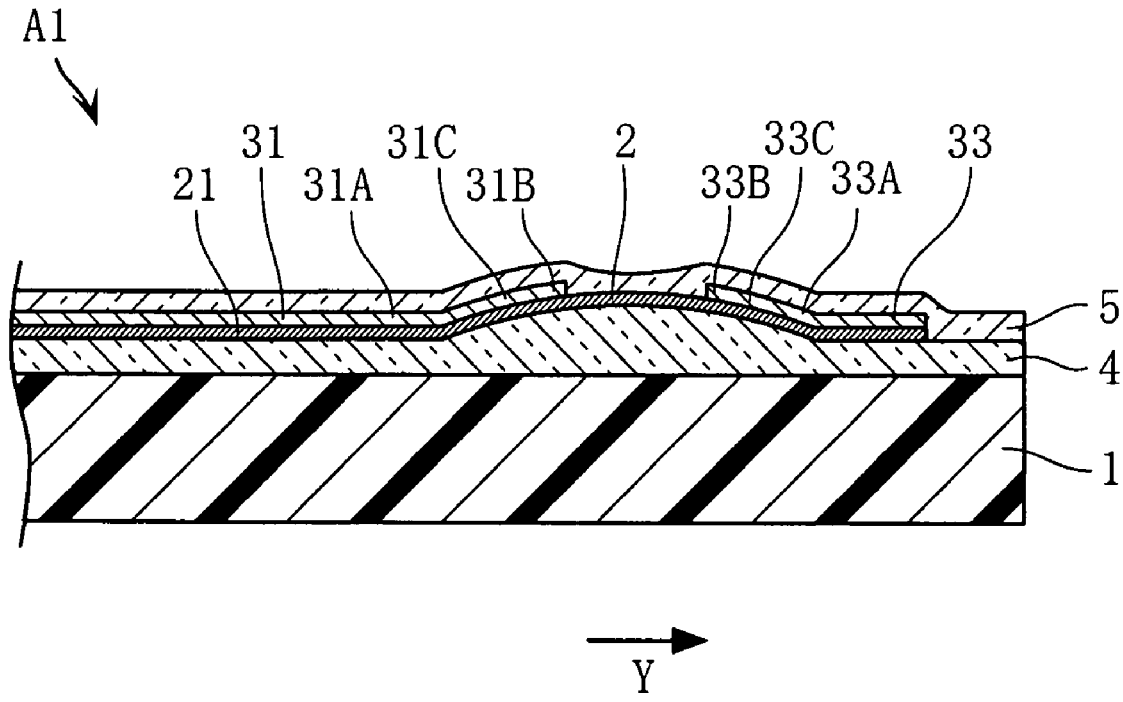
FIG. 2 is a sectional view taken along lines II-II in FIG. 1.

FIGS. 1 and 2 show a thermal printhead according to a first embodiment of the present invention. The thermal printhead Al includes a substrate 1, a plurality of heating portions 2, a plurality of individual electrodes 31, 32, a plurality of intermediate electrodes 33, a glaze layer 4 and a protective layer 5 (not shown in FIG. 1).

The substrate 1 is in the form of a flat rectangular plate elongated in a primary scanning direction X in a plan view and may be made of an insulating material such as alumina ceramic material.

As shown in FIG. 1, the heating portions 2 are aligned in the primary scanning direction X. The heating portions 2 may be made of a $TaSiO_2$ sputtered film or other metal films. As will be described later, a pair of heating portions 2 which are adjacent to each other in the primary scanning direction X form a single print dot.

The individual electrodes 31, 32 and the intermediate electrodes 33 are made of a metal (such as aluminum or gold) having a lower electrical resistance than that of the heating portions 2 and utilized for supplying power to the heating portions 2. The individual electrodes 31, 32 and the intermediate electrode 33 are spaced from each other so as to sandwich the heating portions 2 in the secondary scanning direction Y.

As shown in FIG. 1, each of the intermediate electrodes 33 is U-shaped and positioned downstream from the heating portions 2 in the secondary scanning direction Y. Each intermediate electrode connects two heating portions 2 to each other which are adjacent to each other in the primary scanning direction X.

Both of the individual electrodes 31 and 32 are in the form of a strip extending in the secondary scanning direction Y, positioned upstream from the heating portions 2 in the secondary scanning direction Y and connected to the heating portions 2. The individual electrodes 31 are electrically connected to a common wiring (not shown), whereas the individual electrodes 32 are connected to a drive IC (not shown). The drive IC performs or stops power supply to each of the heating portions 2 by switching.

The respective individual electrodes 31, 32 and intermediate electrodes 33 include wide portions 31A, 32A, 33A, narrow portions 31B, 32B, 33B and tapered portions 31C, 32C, 33C. Each of the wide portions 31A, 32A, 33A has a constant width. The wide portions 31A and 32A constitute most part of the individual electrodes 31 and 32, respectively, so that the width of the wide portions substantially determines the electrical resistance of the individual electrodes 31 and 32. In this embodiment, the width of the wide portions 31A, 32A and 33A is set larger than that of the heating portions 2. The narrow portions 31B, 32B and 33B have a width substantially equal to that of the heating portions 2 and are connected to the heating portions 2.

The tapered portions 31C, 32C, 33C are interposed between the wide portions 31A, 32A, 33A and the narrow portions 31B, 32B, 33B and have a width which reduces as progressing toward the heating portions 2. The edges (first edges) 31Ca, 32Ca, 33Ca of the tapered portions 31C, 32C, 33C, which are the edges located on the inner side of the two paired heating portions 2, extend in parallel with the secondary scanning direction Y. The edges (second edges) 31Cb, 32Cb, 33Cb, which are located on the outer side of the two paired heating portions 2, are inclined with respect to the secondary scanning direction Y.

As shown in FIG. 2, the glaze layer 4 is formed on the substrate 1. The glaze layer 4 may be made of glass and serves to provide a smooth surface suitable for forming a resistor film 21 constituting the heating portions 2, and the individual electrodes 31, 32 and the intermediate electrodes 33. The resistor film 21 is formed on the glaze layer 4. Of the resistor film 21, the portions which are not covered by the individual electrodes 31, 32 and the intermediate electrodes 33 but exposed are the heating portions 2. The heating portions 2 maybe formed by etching utilizing photolithography. The heating portions 2 are formed on an upwardly bulging portion of the glaze layer 4 so as to readily come into contact with thermal paper via the protective layer 5. The protective layer 5 may be made of e.g. glass and covers and protects the heating portions 2, the individual electrodes 31, 32 and the intermediate electrodes 33. In this way, the thermal printhead A1 is structured as a so-called thin-film thermal printhead.

The operation and advantages of the thermal printhead A1 having the above-described structure will be described below.

According to this embodiment, regardless of the width of the heating portions 2, the width of the wide portions 31A, 32A, 33A of the individual electrodes 31, 32 and the intermediate electrodes 33 can be made large. Therefore, the width of the heating portions 2 can be reduced so that the speed of temperature rise at the heating portions 2 in energizing the heating portions 2 can be increased. By the existence of the wide portions 31A, 32A and 33A, the resistance of the individual electrodes 31, 32 and the intermediate electrodes 33 is reduced, so that a large amount of current can be supplied to the heating portions 2. Therefore, the time required for raising the temperature of the heating portions 2 to a temperature suitable for printing is shortened. Thus, both of an increase in definition and an increase in printing speed can be achieved. Further, while reducing the size of the heating portions 3 to perform the high-definition printing, considerable size reduction of the individual electrodes 31, 32 and the intermediate electrodes 33 can be avoided. Therefore, problems such as the disconnection of these electrodes can be avoided.

Further, at the tapered portions 31C, 32C and 33C, only the outer edges 31Cb, 32Cb and 33Cb are inclined. With this structure, the paired heating portions 2 can be kept close to each other. The closer the paired heating portions 2 are to each other, the heating portions 2 heat each other more efficiently when energized. Therefore, the time required for raising the temperature of the heating portions 2 can be shortened without increasing the current to be applied for energization, which is advantageous for increasing the printing speed.

Since the width of the individual electrodes 31, 32 and the intermediate electrodes 33 gradually changes by the existence of the tapered portions 31C, 32C and 33C, the direction in which current flows is not disordered locally at the tapered portions 31C, 32C and 33C. Therefore, the current can flow through the heating portions 2 uniformly along the secondary scanning direction Y. As a result, non-uniform heat generation distribution in the heating portions 2 can be avoided, so that print dots are prevented from being blurred or distorted.

Figure 3:
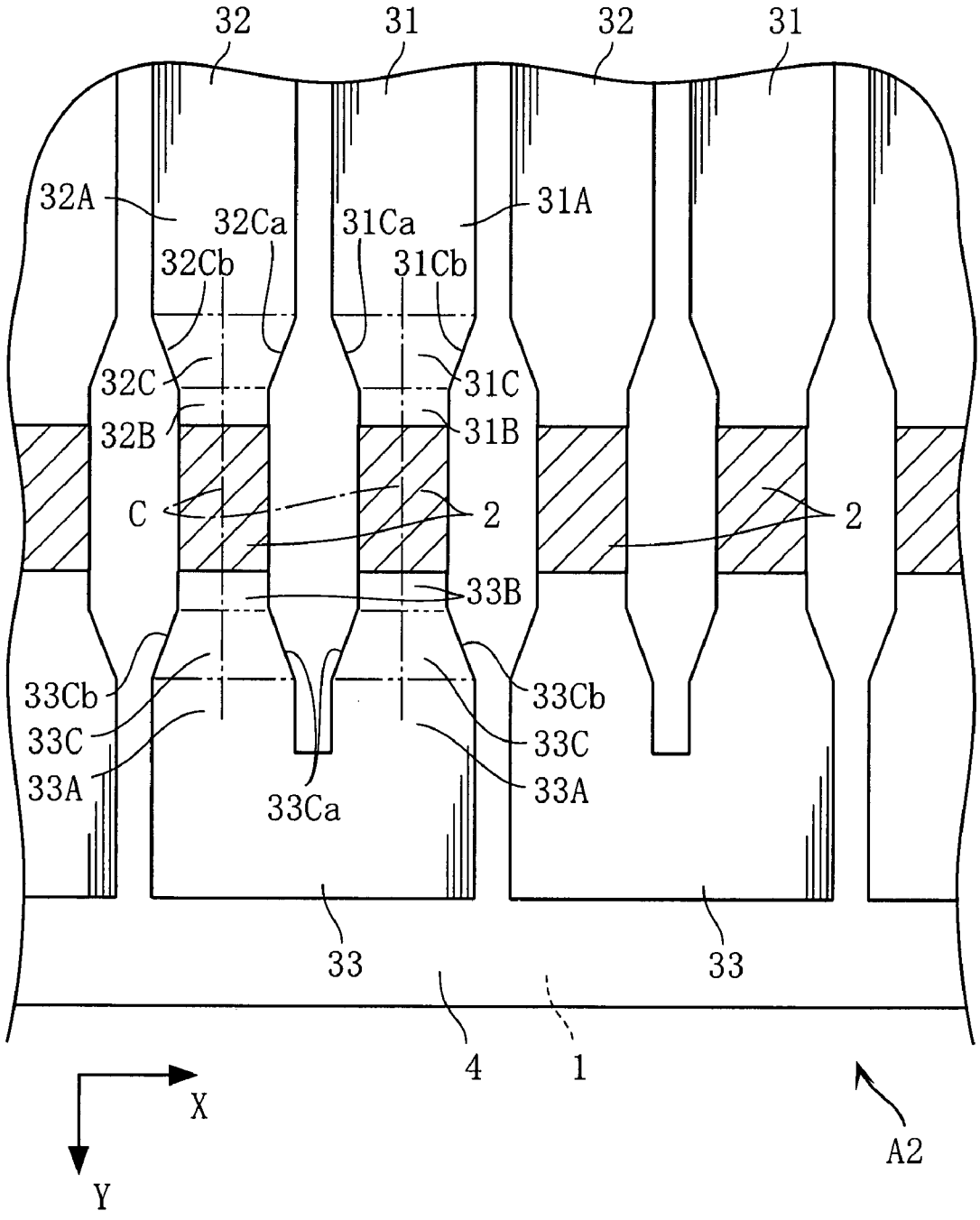
FIG. 3 is a plan view showing a principal portion of a thermal printhead according to a second embodiment of the present invention.
Figure 4:
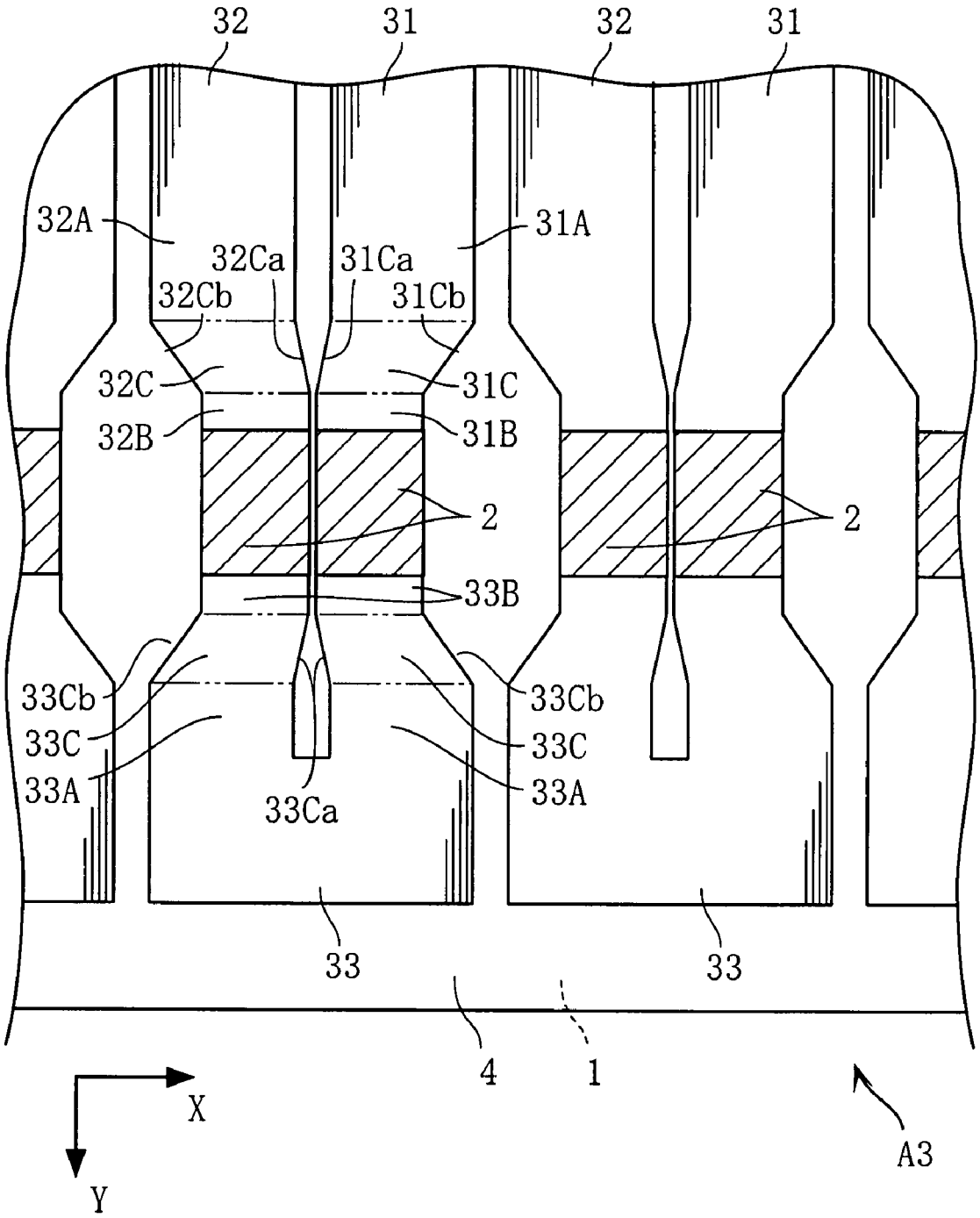
FIG. 4 is a plan view showing a principal portion of a thermal printhead according to a third embodiment of the present invention.
Figure 5:
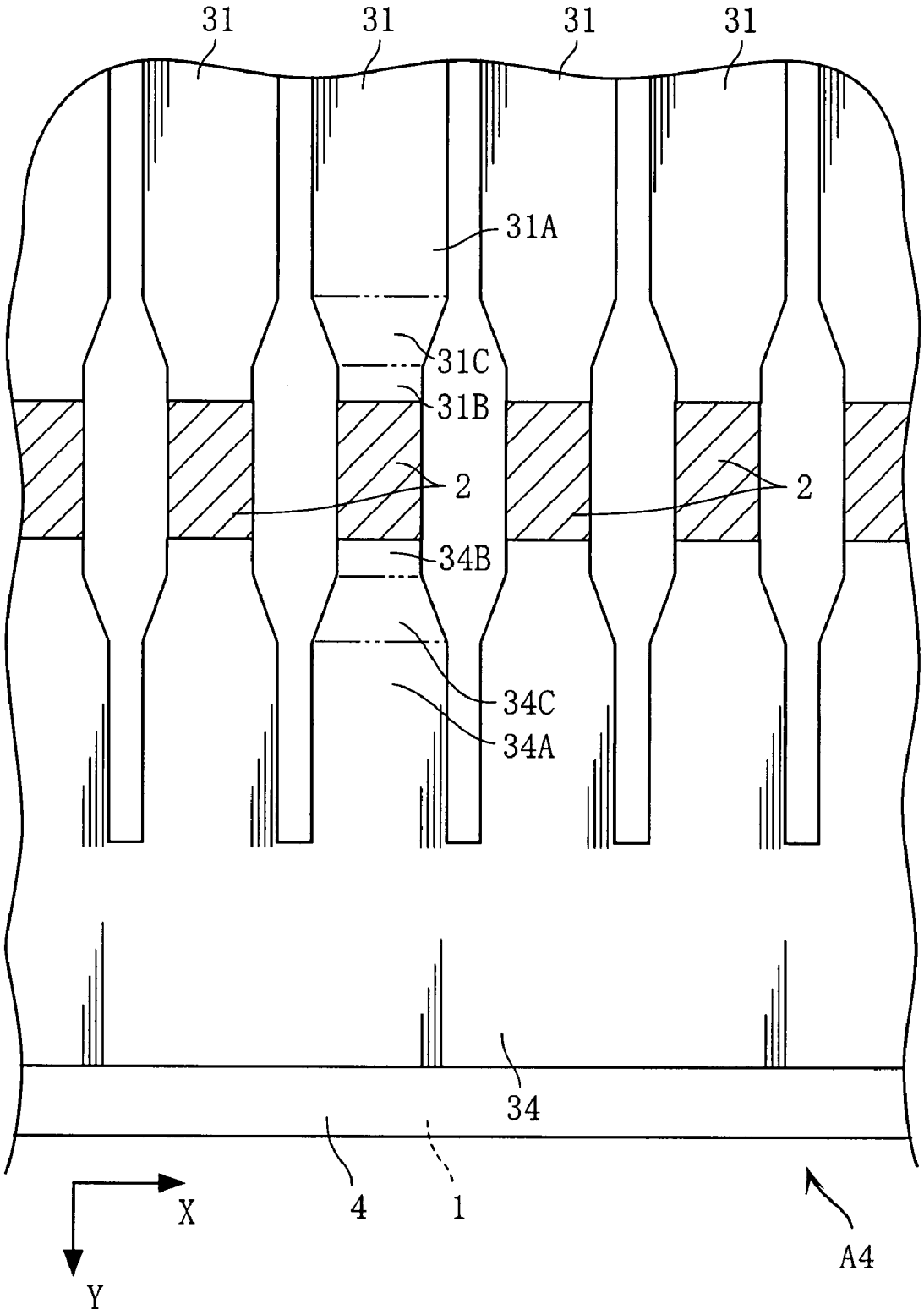
FIG. 5 is a plan view showing a principal portion of a thermal printhead according to a fourth embodiment of the present invention.
Figure 6:
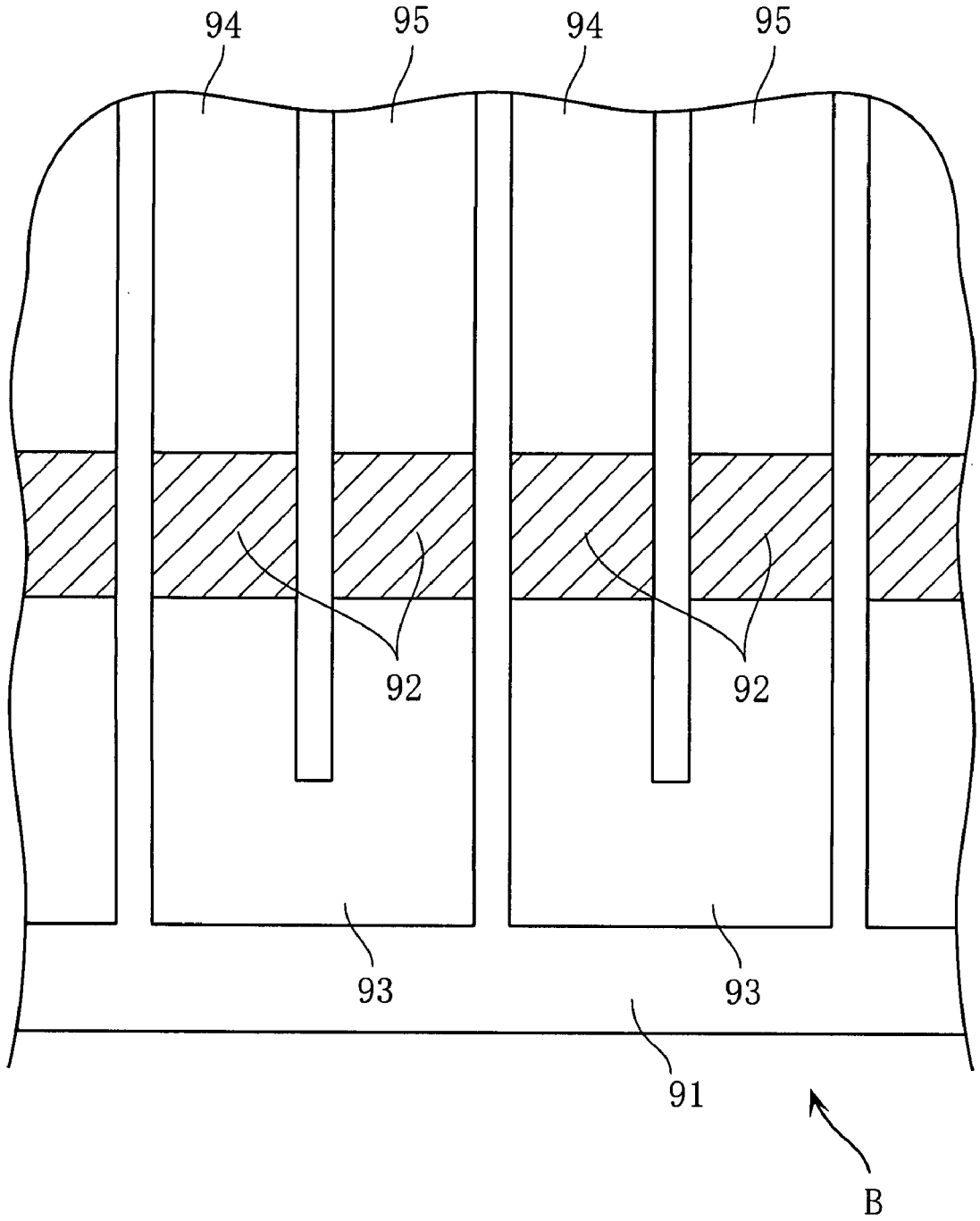
FIG.6 PRIOR ART
FIG. 6 is a plan view showing a principal portion of a conventional thermal printhead.

FIGS. 3-5 show other embodiments of the present invention. In these figures, the elements which are identical or similar to those of the first embodiment are designated by the same reference signs as those used for the first embodiment.

FIG. 3 shows a principal portion of a thermal printhead A2 according to a second embodiment of the present invention. This embodiment differs from the first embodiment in that all of the edges 31Ca, 31Cb, 32Ca, 32Cb, 33Ca, 33Cb of the tapered portions 31C, 32C, 33C are inclined with respect to the secondary scanning direction Y.

At the tapered portions 31C, 32C and 33C, the edges 31Ca, 32Ca, 33Ca and the corresponding edges 31Cb, 32Cb, 33Cb are inclined oppositely but at the same angles with respect to the secondary scanning direction Y. With this arrangement, each of the tapered portions 31C, 32C and 33C is axisymmetric with respect to the center line C of the corresponding heating portion 2 positioned on the relevant narrow portion 31B, 32B, 33B side.

According to the second embodiment, each of the heating portions 2 and the relevant wide portion 31A, 32A, 33A are arranged on the same line. The heating portion 2 and the wide. portion 31A, 32A, 33A are electrically connected to each other via the axisymmetric tapered portion 31C, 32C, 33C. With this arrangement, current flows uniformly in the secondary scanning direction Y through the wide portions 31A, 32A, 33A having a relatively large width and the heating portions 2 having a relatively small width, and the direction of the current is not disordered locally. As a result, non-uniform heat generation distribution in the heating portions 2 can be avoided, so that print dots are more reliably prevented from being blurred or distorted.

Further, according to the second embodiment, a relatively large distance can be secured between the paired heating portions 2. When the distance between paired heating portions 2 is large, the heating portions when energized are prevented from heating each other to reach an excessively high temperature. As noted before, to increase the printing speed, it is desirable to arrange the paired heating portions 2 close to each other like the thermal printhead A1 of the first embodiment. However, to increase the durability of a thermal printhead, it is desirable to employ the arrangement like the thermal printhead A2 of the second embodiment so that the heating portions 2 are not heated to an excessively high temperature. In the second embodiment again, an increase in printing speed is expected owing to the size reduction of the heating portions 2.

FIG. 4 shows a principal portion of a thermal printhead A3 according to a third embodiment of the present invention. This embodiment differs from the second embodiment in that the edges 31Ca and 31Cb of the tapered portion 31C are inclined in the same direction, so are the edges 32Ca and 32Cb of the tapered portion 32C and the edges 33Ca and 33Cb of the tapered portion 33C. According to the third embodiment, the paired heating portions 2 can be arranged further closer to each other, which is advantageous for increasing the printing speed. Since a relatively large distance is secured between the individual electrodes 31 and 32, the electrodes are prevented from being unduly connected electrically to each other.

When the thermal printhead has an electrode pattern which turns around at the intermediate electrodes 33 like the thermal printhead A1-A3, the heating portions 2 can be arranged at a position which is offset toward an edge of the substrate 1. This structure is suitable for pressing the heating portions 2 against e.g. thermal paper with high pressure to perform high-definition and high-speed printing. However, like the thermal printhead A4 shown in FIG. 5 (fourth embodiment of the present invention), the structure including a comb-teeth shaped common electrode 34 maybe employed. With this structure again, by the provision of the tapered portions 31C and 34C, printing can be performed, similarly to the foregoing embodiments, with high definition and high speed.

The thermal printhead according to the present invention is not limited to the foregoing embodiments. The specific structure of each part of the thermal printhead according to the present invention may be varied in design in many ways.

The heating portions are not necessarily provided by utilizing a thin film formed by a thin film forming technique but may be provided by utilizing a thick film formed by a thick film forming technique such as thick film printing. The electrodes may comprise a thin film or a thick film.

The invention claimed is:

1. A thermal printhead comprising:

a substrate;

a plurality of pairs of heating portions arranged on the substrate at a predetermined pitch in a primary scanning direction, each pair of heating portions forming a respective print dot; and a plurality of electrodes connected to the pairs of heating portions;

wherein each of the electrodes includes a tapered portion having a width which reduces toward a corresponding one of the paired heating portions; and wherein a spacing between the paired heating portions is smaller than a spacing between two adjacent non-paired heating portions.

2. The thermal printhead according to claim 1, wherein the electrodes include a plurality of intermediate electrodes each of which is U-shaped, and wherein each of the intermediate electrodes is connected to a respective pair of the heating portions.

3. The thermal printhead according to claim 1, wherein the electrodes include a plurality of pairs of individual electrodes elongated in a secondary scanning direction perpendicular to the primary scanning direction, and wherein each of the paired individual electrodes is connected to a respective one of the paired heating portions.

4. The thermal printhead according to claim 1, wherein the electrodes include a plurality of intermediate electrodes, each of which is U-shaped, and a plurality of pairs of individual electrodes elongated in a secondary scanning direction which is perpendicular to the primary scanning direction, and wherein each of the intermediate electrodes connects the paired heating portions to each other, and wherein each of the paired heating portions is connected to a respective one of the paired individual electrodes.

5. The thermal printhead according to claim 1, wherein the tapered portion includes a first edge and a second edge which are spaced from each other in the primary scanning direction, and wherein the first edge extends in parallel with a secondary scanning direction which is perpendicular to the primary scanning direction, whereas the second edge is inclined with respect to the secondary scanning direction.

6. The thermal printhead according to claim 1, wherein the tapered portion includes a first edge and a second edge which are spaced from each other in the primary scanning direction, and wherein the first edge and the second edge are inclined with respect to a secondary scanning direction which is perpendicular to the primary scanning direction.

7. The thermal printhead according to claim 6, wherein the first edge and the second edge are axisymmetric with respect to an imaginary line extending in parallel with the secondary scanning direction.

* * * * *